US005326409A

United States Patent [19]

Couts, Jr.

[11] Patent Number: 5,326,409

[45] Date of Patent: Jul. 5, 1994

[54] SYSTEM FOR PERIPHERAL DIFFERENTIAL HEAT TREATEMNT TO FORM DUAL-PROPERTY WORKPIECE

[75] Inventor: Wilford H. Couts, Jr., Northboro, Mass.

[73] Assignee: Wyman-Gordon Company, Worcester, Mass.

[21] Appl. No.: 879,089

[22] Filed: May 1, 1992

Related U.S. Application Data

[63] Continuation of Ser. No. 747,451, Aug. 12, 1991, abandoned, which is a continuation of Ser. No. 497,804, Mar. 21, 1990, abandoned, which is a continuation of Ser. No. 233,220, Aug. 17, 1988, abandoned, which is a continuation of Ser. No. 29,615, Mar. 24, 1987, abandoned.

[51] Int. Cl.[5] ..... C21D 1/46

[52] U.S. Cl. ..... 148/631; 148/671; 266/120

[58] Field of Search ..... 148/671, 627, 631, 636; 266/120, 124, 127, 130, 134

[56] References Cited

U.S. PATENT DOCUMENTS

| | | | |
|---|---|---|---|
| 525,574 | 12/1894 | Arbuckle | 134/123 |
| 1,071,012 | 2/1913 | Unger | 148/146 |
| 1,105,116 | 12/1914 | Wales | 134/123 |
| 1,527,410 | 12/1923 | Laughlin | 134/123 |
| 1,697,068 | 12/1929 | Kenney | 134/123 |
| 1,953,647 | 12/1934 | Darrah | 148/10 |
| 2,019,281 | 12/1935 | Walcher | 134/123 |
| 2,154,014 | 12/1939 | Sinclair | 29/152.2 |
| 2,240,493 | 12/1941 | Denneen | 134/123 |
| 2,416,378 | 12/1947 | Chandler | 148/20 |
| 2,535,110 | 12/1950 | Wishart | 148/21.55 |
| 2,596,345 | 5/1952 | Penrod | 134/123 |
| 2,773,565 | 11/1963 | Pye | 148/1 |
| 3,137,752 | 1/1964 | Ankersen | 148/15 |
| 3,154,441 | 4/1964 | Dewez | 148/143 |
| 3,556,877 | 6/1968 | Ujiie | 148/143 |
| 3,741,821 | 6/1973 | Athey et al. | 148/162 |
| 4,026,732 | 5/1977 | Dammel | 148/154 |
| 4,029,526 | 6/1977 | Carrigan | 148/147 |
| 4,177,088 | 8/1979 | Pierrel | 148/15 |
| 4,261,769 | 1/1981 | Usui | 148/39 |
| 4,401,478 | 8/1983 | Pierrel | 148/15 |
| 4,431,464 | 2/1984 | Lincoln | 148/15 |

FOREIGN PATENT DOCUMENTS

| | | |
|---|---|---|
| 2139217 | 1/1973 | France . |
| 2311853 | 12/1976 | France . |
| 706457 | 7/1978 | U.S.S.R. . |
| 2148949 | 6/1985 | United Kingdom . |

OTHER PUBLICATIONS

Frost et al "Deformation-mechanism maps: Case Study: creep of a superalloy turbine blade" (Permagon Press) pp. 148–150, Dec. 1980.

*Primary Examiner*—Scott Kastler
*Attorney, Agent, or Firm*—Blodgett & Blodgett

[57] ABSTRACT

A system for developing a metal workpiece in which the center and the periphery have different properties. The workpiece is processed to put it into a first metallurgical condition. Then, a portion of the periphery is dipped into a molten salt bath and the workpiece is rotated so that the periphery is converted to a second metallurgical condition by the heat of the salt bath.

12 Claims, 1 Drawing Sheet

SYSTEM FOR PERIPHERAL DIFFERENTIAL HEAT TREATEMNT TO FORM DUAL-PROPERTY WORKPIECE

This is a continuation of Ser. No. 07/747,451, filed on Aug. 12, 1991, (now abandoned) which was a continuation of copending application Ser. No. 07/497,804 filed on Mar. 21, 1990, now abandoned, which was a continuation of Ser. No. 07/233,220, filed Aug. 17, 1988 (now abandoned), which was a continuation of Ser. No. 07/029,615, filed Mar. 24, 1987, (now abandoned).

BACKGROUND OF THE INVENTION

The present invention relates in general to the heat treatment of metals and, more particularly, to the heat treatment of superalloy workpieces in which there is a conflict between the desired properties of the center versus those of the periphery.

In the gas turbine engine industry, to which the present invention has particular application, the achievement of absolute maximum engine performance is often limited by the properties of the materials from which the engines are fabricated. The art and science of alloying and treatment of metals to maximize desired properties has developed to a high level of sophistication. These advances in technology can be frustrated, however, when the properties which must be maximized are contradictory, that is, when the maximizing of one property necessarily precludes maximizing another important property. Where the contradictory properties must exist in the same location in the workpiece, a compromise and some sacrifice of one or both of the properties are almost inevitable.

There is one type of situation where the compromise may be avoided. This is when one of the contradictory properties must exist in a first portion of the workpiece and the other contradictory property must exist in another portion of the workpiece. Theoretically, one need only process the workpiece to maximize the properties appropriate to each portion of the workpiece. There are, however, practical problems with achieving this result.

One situation where the contradictory properties exist on separate portions of the workpiece concerns gas turbine engine discs. In operation, these discs are exposed to extremes and cycles of high temperatures and force, as they rotate at speeds in the order of 10,000 rpm. Air foils are dove-tailed into the periphery of the disc and extend radially from the disc. As the turbine rotates at high speed, the dovetail joint between the periphery of the disc and each blade is exposed to extreme stress. Because the periphery is the part of the disc which is exposed to the highest temperatures, high temperature creep resistance becomes a critical property. Its upper limit, in terms of temperature and force, places a limit on the efficiency and capacity of the turbine of which the disk is a part. Generally, in the alloys used in this-application, a coarse grain structure possesses higher creep resistance than a fine grain structure.

The problem of contradictory properties exists in the disc because, whereas the periphery should have relatively coarse grain, the central portion should have relatively fine grain. To maximize the efficiency and capacity of a gas turbine, it is desirable to maximize the tensile strength and low cycle fatigue resistance of the central portion of the discs. This is achieved by relatively fine grain sizes.

The problem of contradictory properties in gas turbine discs is often further complicated by the fact that, in high performance turbines, it is often the case that reliability must approach 100%, because of the consequences of disc failure. Destructive testing becomes impractical, yet nondestructive testing is often not sufficiently indicative of flaws. Thus, practical manufacture of the turbine discs must often rely on the consistent predictability of the results of the processing. This means that the result of the processing must not only be inherently predictable, but also, the process must be capable of being efficiently monitored to be sure that it is being carried out in accordance with the specifications.

With regard to the turbine disc problem, several approaches could be considered. First, the disc could be formed in two pieces; an inner ring and an outer ring. Each could be processed to have its own properties. Then the rings could be welded or diffusion bonded together. Both welding and diffusion bonding, however, can have serious predictability problems and can cause undesirable changes in the properties of the workpieces.

Second, it would be possible to heat treat the whole disc to a coarse state and then forge the central portion to reduce the grain and cause work hardening. This approach can have predictability problems, would be very complicated to carry out effectively, and would provide poor control of the nature and location of the interface between the two portions. Furthermore, the tooling necessary to carry out the process would be very expensive to develop and would be limited to a specific workpiece and a specific set of properties, i.e., it would be inflexible.

Third, it would be possible to treat the entire disc to form fine grain and then to heat the periphery to coarsen the grain by induction heating. It was found that induction heating can be a very imprecise way of heating a specific portion of the disc and could not always be sufficiently controlled to provide reproducible results, with respect to both grain size and interface nature and location.

These and other difficulties experienced with the prior art devices have been obviated in a novel manner by the present invention.

It is, therefore, an outstanding object of the invention to provide a dual-property workpiece system which can be implemented with a new combination of relatively simple, time-tested equipment and operations.

Another object of this invention is the provision of a dual-property workpiece system which provides precisely predictable results.

A further object of the present invention is the provision of a dual-property workpiece system in which the variables can be precisely controlled, monitored and recorded.

It is another object of the instant invention to provide a dual-property workpiece system which can be easily and inexpensively tailored to create a wide range of results in terms to geometry and properties.

A still further object of the invention is the provision of a dual-property workpiece system which is fully compatible with other operations on the workpiece.

It is a further object of the invention to provide a dual-property workpiece system which can create workpieces having geometric property distributions and gradations not practically possible with any other system.

With the foregoing and other objects in view, which will appear as the description proceeds, the invention resides in the combination and arrangement of steps and the details of the structure hereinafter described and claimed, it being understood that changes in the precise embodiment of the invention herein disclosed may be made within the scope of what is claimed without departing from the spirit of the invention.

SUMMARY OF THE INVENTION

The present invention is a system for forming dual-property metal alloy workpieces, specifically peripherally-uniform dual-property workpieces, and more specifically annularly-uniform dual-property workpiece. A dual-property workpiece is a workpiece having a first portion exhibiting a first set of properties and a second portion exhibiting at least one different property. A dual-property workpiece is peripherally uniform when the second portion generally exists about the entire periphery of the workpiece. A dual-property workpiece is annularly-uniform when the interface between the first portion and the second portion is substantially a surface of revolution about an axis of revolution passing through the first portion.

The system of this invention applies to metal alloys in which the microstructure and/or properties can be transformed by heat, hereinafter called heat-transformable alloys. The system is particularly useful when applied to metal alloys in which a fine grain size is increased by heat to an equilibrium grain size which is a function of the temperature, hereinafter called; heat-coarsening alloys. The invention is preferably applied to superalloys, specifically, nickel-based superalloys and, more specifically a nickel-based superalloy known as AF2-1DA-6. The system also has specific application to titanium alloys and more specifically to properties affected by heat treatment above or below the beta-transus.

The system involves the immersion of the rim of a workpiece in a bath of molten salt for a period of time sufficient to effect a transformation in the immersed portion of the workpiece, and, then, the rotation of the workpiece in a continuous or step-wise manner to effect the transformation around the periphery of the workpiece but not in the central portion of the workpiece. Parameters include the workpiece metallurgy and geometry, rotation speed and indexing, the height and angle of axis of rotation with respect to the salt surface (and thus the contact geometry), and the temperature of the salt.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENTS

Figure 1:
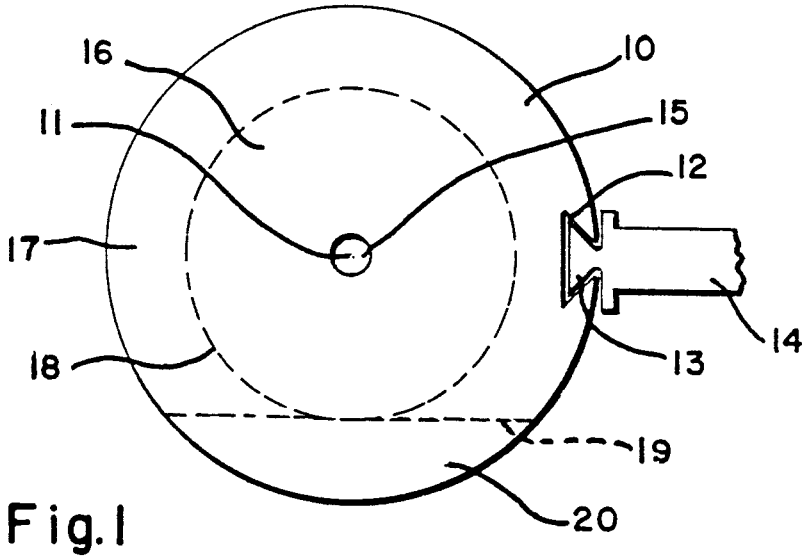
FIG. 1 is view of a dual property workpiece embodying the principles of the present invention.

The nature of this invention may be best understood by reference to a specific implementation. FIG. 1 shows a simplified view of a workpiece 10 embodying the principles of the present invention. The workpiece is a turbine disc preform which is symmetric about an axis 11 except for a dovetail mortise 12 which carries the dovetail tenon 13 of a turbine blade 14. The workpiece 10 has a central bore 15.

This workpiece is optimized if the central portion 16 and the peripheral portion 17, which are separated by a conceptual interface 18 represented by the dashed line, have different grain size and thereby different properties. The interface would normally be substantially a surface of revolution about the axis 11. If the workpiece 10 were immersed in a fluid to the dotted-line 19, a segment 20, the external surface of which would contact the fluid, would be defined.

Figure 2:
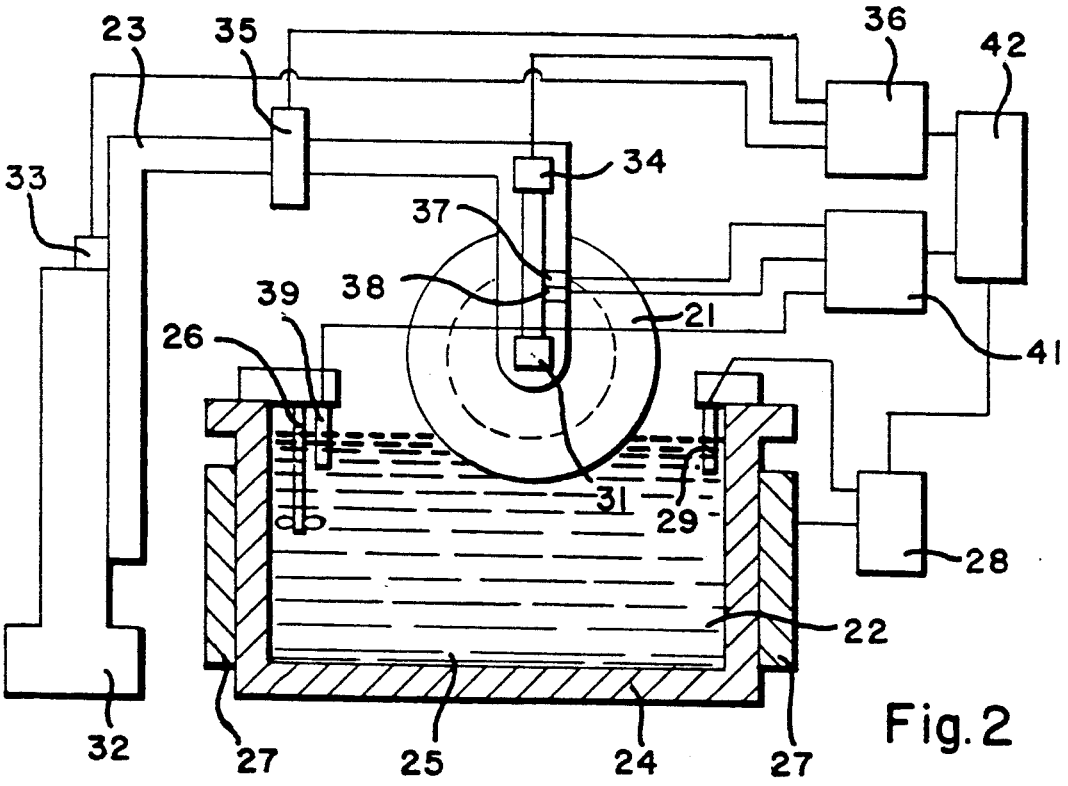
FIG. 2 is a conceptual front elevation view, in partial section, of equipment embodying the principles of the present invention.

FIG. 2 shows a conceptual view of equipment adapted to carry out the present invention. In addition to the disc-shaped workpiece 21, the equipment consists of two main subsystems. The first subsystem is an agitated salt bath 22. The second subsystem is the workpiece manipulator 23.

The salt bath subsystem 22 consists of a tank 24, a body of molten salt 25 selected to be suitable for the particular temperature to which the workpiece is to be exposed, and a power-driven agitator 26. The agitator circulates the molten salt in such a way that the body of salt retains a relatively uniform temperature. While the agitated salt bath is preferred, natural convection can be used where it gives satisfactory results.

The tank 24 is surrounded by heating elements 27 which are controlled by a temperature controller 28. The controller 28 is responsive to temperature sensor 29 which is adapted to monitor the temperature of the salt bath 25.

The workpiece manipulator 23 includes a workpiece holder 31 adapted to hold the workpiece. The workpiece manipulator 23 also includes a base 32 which supports the mechanical elements of the workpiece manipulator 23. Between the workpiece holder 31 and the base 32 are three drivers which control the orientation of the workpiece with respect to the salt bath. The first driver is the elevation driver 33 which controls the height of the workpiece with respect to the surface to the salt bath. The second driver is the rotation driver which rotates the workpiece. The third driver is the tilt driver 35 which is adapted to tilt the axis of rotation of the workpiece with respect to the surface of the salt bath. All three of the drivers are controlled by a programmable manipulator controller 36.

The workpiece manipulator 23 also includes three sensors. The rotation sensor 37 senses the rotation of the workpiece. The elevation sensor 38 senses the elevation of the workpiece above the surface of the salt bath and the orientation of the rotation axis with respect to the surface of the salt bath. The temperature sensor 39 senses the temperature of the salt bath. All three sensors are monitored by the recorder 41 which creates a permanent record of the sensor readings. Both the manipulator controller 36 and the recorder 41 are supervised by the manager 42.

In operation, the salt bath would be brought to the design temperature and the manager 32 would cause the controller 36 to cause elevation driver 33 to lower the workpiece into the salt bath to a predetermined level. If tilting of the axis was desired, the tilt driver 35 would adjust the axis of rotation with respect to the salt bath. At the designated cycle time, the rotation driver 34 would cause the workpiece to rotate. When the processing was complete, the elevation driver 33 would lift the workpiece out of the salt bath. During all times, the recorder 41 would be monitoring the sensors and creating a permanent record of the actual treatment received by the processing. Because of the predictability of the processing, and because of the continuous monitoring of system parameters, quality assurance without destructive testing can be achieved.

While the above description concerns a fully automated embodiment, a semi-automated system is within the scope of this invention.

An initial test of the use of the agitated molten salt bath application without workpiece rotation was carried out on a 4-inch diameter bar of a nickel-based superalloy called AF2-1DA which had been CAPed (Consolidation at Atmospheric Pressure) and extruded from powder. Three 1-inch thick disks were cut from the bar and numbered #13, #14, and #15. The disks were immersed in an agitated salt bath at 2225° F. to a depth of one inch, without rotation, for 3 minutes, 10 minutes and 30 minutes respectively.

The disks showed progressive grain coarsening with time in the bath. Disks #15 showed surface coarsening corresponding to the surface in contact with the salt. Within the body of disc #15, a well-define interface between the fine and coarse grain existed as a curved surface having a thinnest coarse portion in the middle of the disc (that is, the interface is concave when viewed from the axis of the disc), about one half inch from the outer edge of the disc. This test proved that the method could cause a coarsening in a specific portion of the disk bounded by a well-defined interface between fine and coarse grain.

The method was then carried out with rotation of the workpiece. The discs were processed to create a fine grain structure. The discs were then immersed in 2225° F. salt to one inch for 20 minutes, rotated (indexed) 60° and held another 20 minutes. This cycle was repeated until the entire periphery was treated. The result was a relatively uniform coarsening from the edge inward about ¾ inch, so that the grain size followed a smooth transition from ASTM 6 at the edge, ASTM 8 at ½ inch depth, and ASTM 10 at 1 ½ inches in from the edge.

It was noted that the region of the leading edge of each immersed segment displayed significant gamma prime precipitation. This effect, probably caused by differential cooling rates along the segment, would probably be supressed by using a smaller indexing angle approaching continuous slow rotation after the initial immersion time for the first segment.

In the preferred embodiment, for application to the grain coarsening discussed above, the workpiece would be immersed and initially held stationary for a residence time equal to the time required for the grain size within the workpiece to reach the desired equilibrium value for the salt bath temperature (i.e., the equilibrium residence time). The workpiece would then be slowly rotated so that the residence time for each point in peripheral portion of the workpiece equals at least the equilibrium residence time.

While the above rotation schedule is effective, other rotation schedules are also contemplated. For example, one could rotate the workpiece immediately to begin heating the entire rim and then index and overlap rotation to bring the rim to equilibrium at the end of the cycle. Alternatively, one could immediately rapidly rotate several times to preheat the rim uniformly and then slowly rotate to reach equilibrium.

While the specific discussions above focus on nickel-based superalloys, the process is also useful in the processing of titanium-based alloys. For example, the properties of a titanium alloy workpiece can sometimes be determined by carrying out a specific heat treatment step above or below the beta-transus of the alloy. By applying the present invention to a specific processing sequence (rotating the rim through the salt bath to heat treat above the beta-transus), it is possible to form a workpiece with differential properties. More specifically, the rim would have properties determined by the sequence in which the particular heat treatment is carried out above the beta-transus, whereas the central or axial portion would have different properties, determined by sub-beta-transus treatment. This sub-beta-transus "treatment" may, in fact, be no "treatment" at all (insufficient temperature) if above-salt-bath cooling is maximized. On the other hand, the process can be an effective sub-beta-transus heat treatment of the central portion if the cooling environment above the salt bath is regulated (e.g., by convection) to control the temperature of the central portion of the workpiece at a point where sub-beta-transus heat treatment occurs.

Although there are numerous situations in which the present invention could be applied to titanium alloys, one particularly promising application would involve compressor discs for gas-turbines engines. As with nickel-based superalloy discs, it is desirable to maximize creep resistance on the rim, while maximizing fatigue resistance in the central portion.

For the sake of example, a workpiece of Ti 6A1-4V is finish forged in the alpha beta phase field, from a furnace temperature of about 1750° F. (approximately beta transus minus 75° F.). It is then solution annealed, again below the beta transus, at perhaps 1775° F., in order to set a primary alpha to beta ratio of approximately 15%; water or oil quenching follows this solution anneal, forming a needle-like Widmanstatten structure in the continuous phase beta matrix. Such a structure, after stabilization annealing at 1300° F., provides an excellent combination of properties —notably tensile strength and fatigue. Now to improve the creep resistance in the rim area, the disk would then be rotated through the molten salt, by a mechanism in accordance with the present invention. The temperature of the bath would be above the beta transus of the material, say 1850° F. to 1950° F. The contact time would be sufficient to effect the desired transformed beta grain structure, but not so long as to result in excessive grain growth. This transformed beta structure has been found to be the best for maximizing creep resistance. After again water or oil quenching, the whole disk would be stabilization annealed at 1300° F., 2 hours air cooled.

One of the advantages of the molten salt bath concept is that the heat transfer to the workpiece surface in contact with the salt is very fast and very predictable. As a result, the process can be very accurately modeled. Furthermore, the outcome determinative parameters can be easily set, monitored, controlled, and recorded, thus making process control, quality control, and quality assurance effective with non-destructive methods.

The amount of heat flow, and the depth of heat penetration, and therefore, the shape and location of the interface between the altered and non-altered portion of the workpiece can be reliably controlled by setting the speed of rotation, the depth of immersion, the cooling condition above the salt bath, and the bath temperature. The number of exposure rotations can be set to greater than one in appropriate situations.

The height of the axis of rotation of workpiece above the salt surface can be set, or, in fact, programably varied, or even angled, to control the location and shape of the interface between the heat altered and non-heat-altered portions of the workpiece.

The system can be easily applied to a wide range of shapes of workpiece and can be used on workpieces of any prior history including cast, wrought or powder-formed parts. The system can be applied to both ganuna prime and carbide strengthened alloys, and before or after finish forging or other uniform heat treatments, for precipitation or other control. The system can also be used for differential stabilization or differential aging of the central portion versus the peripheral portion to achieve dual-property workpieces.

The application of the present invention to the concept of differential aging provides a number of very interesting possibilities. Of specific interest is the application of the invention to the process of precipitation hardening by which certain alloys can be hardened by forming a fine and uniform dispersion of a secondary or hardening phase in the primary alloy phase. In conventional precipitation hardening, the workpiece first receives solution treatment in which the workpiece is heated to a temperature above the solvus of the secondary phase, so that the secondary phase, which is often concentrated at primary phase grain boundaries, is dissolved in the primary phase, resulting in a uniform phase. Second, the workpiece is quenched to freeze the alloy as a roetastable supersaturated solid solution. Third, in the age treatment, the workpiece is brought to an elevated temperature below the secondary phase solvus. Initial nucleation and growth of secondary phase results in the formation of a uniform dispersion of numerous fine secondary phase particles throughout the primary phase grains. As these particles grow in size, at first by diffusion from the body of solid solution and then at the expense of smaller secondary phase particles, the overall hardening effect of the secondary phase goes through a maximum with time. When the workpiece is treated for a time beyond that time resulting in maximum hardness, the hardness decreases and the workpiece is said to be overaged.

The present invention has at least three applications to the precipitation hardening process discussed above. In the first application, the invention could be used to solution treat only the rim of the workpiece. If processing is otherwise conventional as described above, the resulting workpiece could have a precipitation hardened periphery and a central portion with a very different microstructure. This is because, in some systems, the solution treatment is a necessary precursor to subsequent transformations. This approach is attractively simple because the solution treatment is a equilibrium process, i.e., the results are not time critical after a minimum time has expired. Thus, salt bath contact time is not critical.

In a second application, the invention could be applied to age treat the rim. This would result in a workpiece having a hardened rim and a central portion having the properties, at least temporarily, of an underaged material. Because the age treatment is a dynamic process, i.e., the result is time dependent, the contact time in the salt bath must be more carefully controlled in this application than in those involving equilibrium processes.

A third application involves overaging only the rim of the workpiece. This would result in a workpiece with an overaged rim and an age hardened central portion.

Although the above applications only recite use of this invention in one step of the precipitation hardening process, it is within the contemplation of this invention to use the system of the present invention in more than one step (first and second, or second and third, or first and third, or all three) to achieve specific results in terms of differential properties.

While the simplest application of this invention would involve holding the axis of the workpiece stationary as the workpiece is rotated, the invention contemplates variations. The system could be programmed so that the axis follows a motion cycle between each complete rotation. The system could be programmed so that the axis moves gradually and continuously (linearly or non-linearly) toward or away from the salt as the workpiece rotates. The system could also be programmed so that the axis moves step-wise upon each complete rotation. Each mode of motion would cause different results.

Another application of the present invention involves stabilizing carbides. In certain alloy systems, i.e. Waspalloy, it is important to avoid grain boundary films of $M_{23}C_6$ carbides, because they cause embrittlement. Thermal processing of the alloy to convert a continuous $M_{23}C_6$ film to descrete globular carbides is called carbide stabilization. If a disc of Waspalloy were processed to form uniform fine gamma prime, the disc would be hard and not brittle. However, if the rim were merely coarsened by heating, the carbides might convert to film in subsequent processing or service and the rim would be embrittled. However if the system of the present invention is used to treat the rim at 1865° F. or higher and then process at 1550° F., the spheroidal carbides in the rim are stabilized. Film-forming and embrittlement of the rim during subsequent overall aging and service is resisted.

Ordinarily, the axis of rotation of the workpiece would be held above the surface of the molten salt. It is within the contemplation of this invention to partially immerse the workpiece in the bath and rotate about an axis below the surface of the salt bath. By cooling the workpiece portion passing outside of the bath, it is possible to have a higher intensity of heat treatment on the center of the workpiece than would occur on the peripheral portion. This would, of course, have the inverse effect on heat-treatment-effected properties than would occur with the axis above the salt surface.

Another application of the present invention involves composite workpieces. There are situations where, for example, it would be desireable to form a disc with a central portion of one alloy and a peripheral portion of another alloy. The two alloys would be diffusion bonded together. After the bonding is accomplished, however, it is often desireable to expose each alloy to a different heat treatment process to prepare the disc for service. The system of the present invention would provide a simple and effective way to treat each alloy in its own way.

While this invention is particularly applicable to workpieces formed from powder metal alloys, the invention is also applicable to conventional cast and/or wrought alloys.

While it will be apparent that the illustrated embodiments of the invention herein disclosed are calculated adequately to fulfill the objects and advantages primarily stated, it is to be understood that the invention is susceptible to variation, modification, and change within the spirit and scope of the subjoined claims.

The invention having been thus described, what is claimed as new and desired to secure by Letters Patent is:

1. A method of heat treating each of a plurality of metal workpieces each having a central portion, an axis, and a peripheral portion having an outer surface, whereby the central portions and peripheral portions area put into different metallurgical states with peripherally and annularly uniform interface between them, comprising the steps of:

(a) brining the workpiece to a first metallurgical state, using a first temperature range, (b) partially immersing the workpiece into a molten salt bath having a second chosen treatment temperature range, higher than said first temperature range, the bath having a well-defined surface, (c) controlling the height and angle of an axis of rotation of the workpiece with respect to said well-defined surface of the salt bath, and (d) rotating the workpiece about the axis to cause thermal contact between the salt bath and the outer surface of the peripheral portion at such speed and for such time as to cause the transformation of the peripheral portion to a changed metallurgical state.

2. A method as recited in claim 1, wherein the workpiece is immersed and held immobile until a steady state is achieved and then rotation is begun.

3. A method as recited in claim 1, wherein the workpiece is rotated rapidly several times to heat the peripheral portion uniformly then rotated slowly to reach equilibrium.

4. A method as recited in claim 2, applied to each of a plurality of workpieces formed of a nickel-based superalloy or titanium-based alloy each workpiece having a central portion and a peripheral portion, so that the central portion has a first microstructure or age treatment state and the peripheral portion has a second microstructure or age treatment state, said contact being for such time that the microstructure or age treatment state of the peripheral portion is changed to an equilibrium value.

5. A method as recited in claim 4, wherein the microstructure of the periphery is changed from fine-grained to coarser-grained during treatment in the salt bath.

6. A method as recited in claim 4, wherein the periphery is precipitation hardened during treatment in the salt bath.

7. A method as recited in claim 4, wherein the peripheral portion of a titanium-based superalloy having a beta-transus is treated above the beta-transus, during treatment in the salt bath and the central portion is treated sub-beta-transus.

8. Method as recited in claim 4, applied to a titanium superalloy disc having a beta-transus, wherein the method includes the steps of:

(a) finish forging the disc in the alpha-beta phase field, from a furnace temperature of about 1750° F. (approximately beta transus minus 75° F.), (b) solution annealing below the beta transus at about 1775° F., to set a primary alpha to beta ratio of approximately 15%, (c) water or oil quenching, forming a Widmanstatten structure in a continuous phase beta matrix, (d) stabilization annealing at 1300° F., (e) rotating the disc through the molten salt at the beta transus of the material, about 1850° F. to 1950° F., for a contact time sufficient to effect the desired transformed beta grain structure, but not so long as to result in excessive grain growth, (f) water or oil quenching, (g) stabilization annealing the disc at 1300° F., and (h) air cooling.

9. A method as recited in claim 4, applied to a disc to stabilize carbides and avoid grain boundary films of $M_{23}C_6$ carbides, including the further steps of:

(a) thermally processing the alloy to convert a continuous $M_{23}C_6$ film to discrete globular carbides (carbide stabilization), (b) processing to form uniform fine gamma prime, to make the disc hard and not brittle, (c) treating the rim at 1865° F. or higher during treatment in the salt bath, and (d) processing the disc at 1550° F., whereby the spheroidal carbides in the rim are stabilized, and whereby film-forming and embrittlement of the rim during subsequent overall aging and service is resisted.

10. An apparatus for forming a plurality of disc-shaped workpieces each workpiece having an axis and a central portion in one physical state having an annularly and peripherally uniform interface with a peripheral portion in a second physical state wherein the location and shape of the interface of each workpiece is substantially identical compared with each other such interface comprising, (a) a bath of molten salt having a uniform temperature near a well-defined surface, (b) an elevation driver and controller adapted to hold each workpiece at the axis, to set the axis orientation, and to move the periphery of the workpiece into and out of the bath, (c) a rotation driver and controller adapted to rotate the workpiece about the axis while it is held by the elevation driver, and (d) a temperature sensor and temperature controller for the salt bath.

11. An apparatus as recited in claim 10, wherein the apparatus has a monitor which senses and permanently records the values of process parameters over the time of forming the workpiece, the parameters including elevation, rotation speed, temperature, and time.

12. A system as recited in claim 10 wherein a programmable controller is provided and adapted to control and coordinate the elevation driver, the rotation driver, and the temperature controller.

* * * * *